US009601013B2

(12) United States Patent
Wongpiromsarn et al.

(10) Patent No.: US 9,601,013 B2
(45) Date of Patent: Mar. 21, 2017

(54) TRAFFIC SIGNAL CONTROL METHOD AND TRAFFIC SIGNAL CONTROLLER

(71) Applicants: Massachusetts Institute of Technology, Cambridge, MA (US); Nanyang Technological University, Singapore (SG)

(72) Inventors: Tichakorn Wongpiromsarn, Singapore (SG); Emilio Frazzoli, Cambridge, MA (US); Danwei Wang, Singapore (SG); Tawit Uthaicharoenpong, Singapore (SG); Yu Wang, Singapore (SG)

(73) Assignees: Massachusetts Institute of Technology, Cambridge, MA (US); Nanyang Technological University, Singapore (SG)

( * ) Notice: Subject to any disclaimer, the term of this patent is extended or adjusted under 35 U.S.C. 154(b) by 307 days.

(21) Appl. No.: 14/362,043

(22) PCT Filed: Jan. 10, 2013

(86) PCT No.: PCT/SG2013/000014
§ 371 (c)(1),
(2) Date: May 30, 2014

(87) PCT Pub. No.: WO2013/105903
PCT Pub. Date: Jul. 18, 2013

(65) Prior Publication Data

US 2014/0375475 A1 Dec. 25, 2014

Related U.S. Application Data

(60) Provisional application No. 61/584,881, filed on Jan. 10, 2012.

(51) Int. Cl.
*G08G 1/08* (2006.01)
*G08G 1/01* (2006.01)
*G08G 1/083* (2006.01)

(52) U.S. Cl.
CPC ..... *G08G 1/08* (2013.01); *G08G 1/01* (2013.01); *G08G 1/083* (2013.01)

(58) Field of Classification Search
None
See application file for complete search history.

(56) References Cited

U.S. PATENT DOCUMENTS 3,374,340 A * 3/1968 Auer, Jr. ..... G06G 7/76 340/911
3,506,808 A * 4/1970 Riddle, Jr. ..... G08G 1/0104 340/911

(Continued)

FOREIGN PATENT DOCUMENTS

CN 101789183 7/2010

OTHER PUBLICATIONS

International Search Report dated Feb. 22, 2013 for co-pending PCT Application No. PCT/SG2013/000014; 5 pages.

*Primary Examiner* — Quan-Zhen Wang
*Assistant Examiner* — Chico A Foxx
(74) *Attorney, Agent, or Firm* — Hovey Williams LLP

(57) ABSTRACT

A distributed traffic signal control method is provided for a directed network comprising a plurality of junctions, each junction having a plurality of links connected thereto, the links comprising one or more upstream links and one or more downstream links, the method comprising: activating one of a plurality of phases of the junction for a predetermined time period which maximizes the directed network throughput based on current differential traffic backlogs between said one or more upstream links and said one or more downstream links, each phase providing a unique (Continued)

combination of traffic signals at the junction for guiding traffic from the upstream link(s) to the downstream link(s). There is also provided a corresponding traffic signal controller, a traffic control system comprising the traffic signal controller, and a computer readable medium having stored therein computer executable codes for instructing a computer processor to execute the distributed traffic signal control method.

16 Claims, 12 Drawing Sheets

(56) References Cited

U.S. PATENT DOCUMENTS 3,920,967 A * 11/1975 Martin ..... G08G 1/08 340/913
4,370,718 A * 1/1983 Chasek ..... G08G 1/08 340/911
5,357,436 A * 10/1994 Chiu ..... G08G 1/081 340/916
6,496,773 B1 * 12/2002 Olsson ..... G08G 1/01 701/117
6,587,778 B2 7/2003 Stallard et al.
8,050,854 B1 * 11/2011 Chandra ..... G08G 1/081 340/917
8,830,086 B2 * 9/2014 Cao ..... G08G 1/082 340/910
9,014,955 B2 * 4/2015 Sakakibara ..... G08G 1/0116 701/118
9,159,229 B2 * 10/2015 Xie ..... G08G 1/08
9,349,288 B2 * 5/2016 Raamot ..... G08G 1/08
2013/0013178 A1 * 1/2013 Brant ..... G08G 1/0116 701/117
2013/0103291 A1 * 4/2013 Hayashida ..... G08G 1/0125 701/117
2013/0176146 A1 * 7/2013 Dusparic ..... G08G 1/07 340/907
2014/0210645 A1 * 7/2014 Sharma ..... G08G 1/052 340/907
2014/0320316 A1 * 10/2014 Peri ..... G08G 1/08 340/907
2016/0027299 A1 * 1/2016 Raamot ..... G08G 1/08 340/917

* cited by examiner

TRAFFIC SIGNAL CONTROL METHOD AND TRAFFIC SIGNAL CONTROLLER

RELATED APPLICATIONS

This application is a national stage application, under 35 U.S.C. §371 of International Patent Application No. PCT/SG2013/000014, filed on Jan. 10, 2013 and published as WO 2013/105903 on Jul. 18, 2013, which claims priority to U.S. Provisional Application No. 61/584,881, filed on Jan. 10, 2012, which is hereby incorporated by reference in its entirety.

FIELD OF INVENTION

The invention relates to a traffic signal control method and traffic signal controller, and more particularly, a distributed traffic signal control method and the associated traffic signal controller and traffic control system.

BACKGROUND

Traffic signal control is a key element in traffic management that affects the efficiency of urban traffic systems. Most major cities currently employ adaptive traffic signal control systems where the traffic light timing is adjusted based on the current traffic situation. Examples of such adaptive traffic signal control systems are SCATS (Sydney Coordinated Adaptive Traffic System) and SCOOT (Split Cycle Offset Optimisation Technique).

Control variables in traffic signal control systems typically include phase, cycle length, split plan and offset. A phase specifies a combination of one or more traffic movements simultaneously receiving the right-of-way during a signal interval. Cycle length is the time required for one complete cycle of signal intervals. A split plan defines the percentage of the cycle length allocated to each of the phases during a signal cycle. Offset is used in coordinated traffic control systems to reduce frequent stops at a sequence of junctions. SCATS appears to attempt to equalize the degree of saturation (DS), i.e., the ratio of effectively used green time to the total green time, for all the approaches. SCATS appears to employ a heuristic approach to compute cycle length, with various parameters that have to be tuned to achieve this objective. In addition, all the possible split plans have to be pre-specified and a voting scheme has to be used in order to select a split plan in order to obtain approximately equal DS for all the approaches.

Systems and control theory has also been recently applied to traffic signal control. Optimization-based approaches have also been considered. However, one of the major drawbacks of these approaches is the issue of scalability. In other words, such approaches do not scale well with the size of the road network while ensuring satisfactory performance.

Backpressure routing is a technique that has been mainly applied to communication networks, where a packet may arrive at any node in the network and can only leave the system when it reaches its destination node. However, backpressure routing cannot be simply implemented for traffic signal control. For example, backpressure routing requires the knowledge of the destination of each packet and treats packets with different destinations differently. In traffic signal control, however, vehicles traveling in the same direction through a junction cannot be differentiated based on their destination and controlled differently. As a result, implementing backpressure routing in traffic signal control requires the assumption that all the vehicles have a common destination, which is not reasonable. Secondly, backpressure routing assumes that the controller has complete control over routing of the traffic around the network. In traffic signal control, the controller does not have control over the route picked by each driver. Thirdly, backpressure routing also assumes that the network controller has control over the rate of sending each commodity data during each time slot. However, the traffic signal controller does not have control over the flow rate of each traffic movement once a phase is activated.

A need therefore exists to provide a traffic signal control method and traffic signal controller that seek to address at least one of the abovementioned problems.

SUMMARY

According to a first aspect of the present invention, there is provided a distributed traffic signal control method for a directed network comprising a plurality of junctions, each junction having a plurality of links connected thereto, the links comprising one or more upstream links and one or more downstream links, the method comprising:

activating one of a plurality of phases of the junction for a predetermined time period which maximizes the directed network throughput based on current differential traffic backlogs between said one or more upstream links and said one or more downstream links connected to the junction, each phase providing a unique combination of traffic signals at the junction for guiding traffic from said one or more upstream links to said one or more downstream links.

Preferably, each current differential traffic backlog is determined based on a difference between a current traffic condition of one of the downstream links and a current traffic condition of one of the upstream links.

The current traffic condition may comprise a queue length of vehicles at the link.

Preferably, said activating one of a plurality of phases is based on said current differential traffic backlogs and a flow rate of traffic through the junction.

In an embodiment, the flow rate of traffic through the junction is determined based on a comparison of a current traffic state at the junction with a prior model or data so as to locate a predetermined flow rate corresponding to the current traffic state.

In another embodiment, the flow rate is measured by a traffic monitoring system at the junction;

Preferably, the method further comprises: determining, for each phase, a parameter based on a sum of the multiplication of the current differential traffic backlog with the flow rate of traffic for each unique combination of one upstream link and one downstream link of the plurality of links connected to the junction;

Preferably, the method further comprises determining one or more phases having the parameter with a largest value, wherein said activating one of a plurality of phases comprises selecting one of said one or more phases having the parameter with the largest value.

Preferably, the upstream link is a link for providing inflow of traffic to the junction and the downstream link is a link for receiving outflow of traffic from the junction.

According to a second aspect of the present invention, there is provided a traffic signal controller for a directed network comprising a plurality of junctions, each junction having a plurality of links connected thereto, the links comprising one or more upstream links and one or more downstream links, the controller comprising: a control unit for activating one of a plurality of phases of the junction for a predetermined time period which maximizes the directed network throughput based on current differential traffic backlogs between said one or more upstream links and said one or more downstream links connected to the junction, each phase providing a set of traffic signals at the junction for guiding traffic from said one or more upstream links to said one or more downstream links.

Preferably, each current differential traffic backlog is determined based on a difference between a current traffic condition of one of the downstream links and a current traffic condition of one of the upstream links.

The current traffic condition may comprise a queue length of vehicles at the link.

Preferably, the control unit is operable to activate said one of a plurality of phases based on said current differential traffic backlogs and a flow rate of traffic through the junction.

In an embodiment, the flow rate of traffic through the junction is determined based on a comparison of a current traffic state at the junction with a prior model or data so as to locate a predetermined flow rate corresponding to the current traffic state.

In another embodiment, the flow rate is measured by a traffic monitoring system at the junction.

Preferably, for each phase, the control unit is operable to determine a parameter based on a sum of the multiplication of the current differential traffic backlog with the flow rate of traffic for each unique combination of one upstream link and one downstream link of the plurality of links connected to the junction.

Preferably, the controller is further operable to determine one or more phases having the parameter with a largest value, wherein said one of a plurality of phases activated is one of said one or more phases having the parameter with the largest value.

Preferably, the upstream link is a link for providing inflow of traffic to the junction and the downstream link is a link for receiving outflow of traffic from the junction.

According to a third aspect of the present invention, there is provided a traffic control system for a directed network comprising a plurality of junctions, each junction having a plurality of links connected thereto, the links comprising one or more upstream links and one or more downstream links, the system comprising:

one or more traffic signal controllers according to the above-described second aspect of the present invention for directing traffic through one or more junctions in the directed network; and one or more traffic monitoring units for monitoring current traffic condition at one or more links and providing data indicative of the current traffic condition at said one or more links to the traffic signal controllers.

According to a fourth aspect of the present invention, there is provided a computer readable medium having stored therein computer executable codes for instructing a computer processor to execute a distributed traffic signal control method according to the above-described first aspect of the present invention.

BRIEF DESCRIPTION OF THE DRAWINGS

Example embodiments of the invention will be better understood and readily apparent to one of ordinary skill in the art from the following written description, by way of example only, and in conjunction with the drawings, in which.

DETAILED DESCRIPTION

Figure 1:
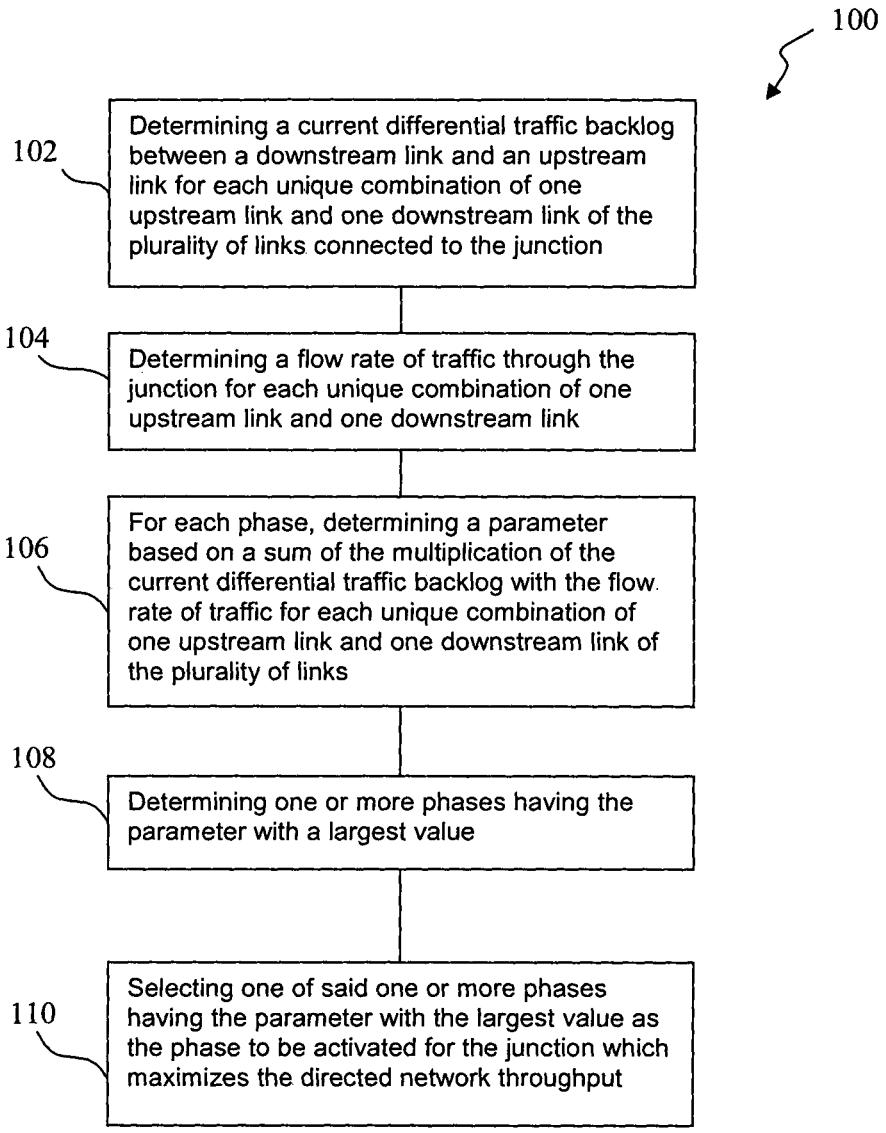
FIG. 1 is a flow chart illustrating a distributed traffic signal control method in accordance with an embodiment of the invention.

Some portions of the description which follows are explicitly or implicitly presented in terms of algorithms and functional or symbolic representations of operations on data within a computer memory. These algorithmic descriptions and functional or symbolic representations are the means used by those skilled in the data processing arts to convey most effectively the substance of their work to others skilled in the art. An algorithm is here, and generally, conceived to be a self-consistent sequence of steps leading to a desired result. The steps are those requiring physical manipulations of physical quantities, such as electrical, magnetic or optical signals capable of being stored, transferred, combined, compared, and otherwise manipulated.

Unless specifically stated otherwise, and as apparent from the following, it will be appreciated that throughout the present specification, discussions utilizing terms such as "scanning", "calculating", "determining", "replacing", "generating", "initializing", "outputting", or the like, refer to the action and processes of a computer system, or similar electronic device, that manipulates and transforms data represented as physical quantities within the computer system into other data similarly represented as physical quantities within the computer system or other information storage, transmission or display devices.

The present specification also discloses an apparatus for performing the operations of the methods. Such apparatus may be specially constructed for the required purposes, or may comprise a general purpose computer or other device selectively activated or reconfigured by a computer program stored in the computer. The algorithms and displays presented herein are not inherently related to any particular computer or other apparatus. Various general purpose machines may be used with programs in accordance with the teachings herein. Alternatively, the construction of more specialized apparatus to perform the required method steps may be appropriate. The structure of a conventional general purpose computer will appear from the description below.

In addition, the present specification also implicitly discloses a computer program, in that it would be apparent to the person skilled in the art that the individual steps of the method described herein may be put into effect by computer code. The computer program is not intended to be limited to any particular programming language and implementation thereof. It will be appreciated that a variety of programming languages and coding thereof may be used to implement the teachings of the disclosure contained herein. Moreover, the computer program is not intended to be limited to any particular control flow. There are many other variants of the computer program, which can use different control flows without departing from the spirit or scope of the invention.

Furthermore, one or more of the steps of the computer program may be performed in parallel rather than sequentially. Such a computer program may be stored on any computer readable medium. The computer readable medium may include storage devices such as magnetic or optical disks, memory chips, or other storage devices suitable for interfacing with a general purpose computer. The computer readable medium may also include a hard-wired medium such as exemplified in the Internet system, or wireless medium such as exemplified in the GSM mobile telephone system. The computer program when loaded and executed on such a general-purpose computer effectively results in an apparatus that implements the steps of the preferred method.

The invention may also be implemented as hardware modules. More particular, in the hardware sense, a module is a functional hardware unit designed for use with other components or modules. For example, a module may be implemented using discrete electronic components, or it can form a portion of an entire electronic circuit such as an Application Specific Integrated Circuit (ASIC). Numerous other possibilities exist. Those skilled in the art will appreciate that the system can also be implemented as a combination of hardware and software modules.

Embodiments of the present invention seek to provide a traffic signal control method and a traffic signal controller for a directed road network. The traffic signal controller is implemented in a distributed manner in the sense that the traffic signal controller at each junction can be run independently from other junctions, requiring only the measure of queue length on the roads that connect to that junction and the current traffic state around the junction. Embodiments of the present invention can be advantageously applied to an arbitrarily large traffic network.

In an example embodiment of the present invention, there is provided a distributed traffic signal control method for a directed road network N. The directed road network N comprises a plurality of signalized junctions, each junction including one or more links. The one or more links may be referred to as either "upstream" links or "downstream" links. "Upstream" links provide inflow of traffic into the junction and "downstream" links receive outflow of traffic from the junction.

In the example embodiment, N and L are the number of links and junctions, respectively in the directed road network N. Then, N can be written as N=(L,J), where $L=\{L_1, \ldots, L_N\}$ and $J=\{J_1, \ldots, J_L\}$ are sets of all the links and signalized junctions, respectively, in N. Each junction $J_i$ can be described by a tuple $J_i=(M_i,P_i,Z_i)$, where $M_i \subseteq L^2$ is the set of all the possible traffic movements through $J_i$, $P_i \subseteq 2^{M_i}$ is the set of all the possible phases of $J_i$, and $Z_i$ is a finite set of traffic states, each of which captures factors such as traffic and weather conditions that affect the flow rate of some traffic movement around $J_i$. $(L_a,L_b) \in M_i$ only if a vehicle may enter and exit $J_i$ through $L_a$ and $L_b$, respectively. Each phase $p \subseteq M_i$ defines a combination of traffic movements simultaneously receiving the right-of-way. That is, each phase provides a unique combination of traffic signals at the junction for guiding traffic from one or more upstream links to one or more downstream links.

According to an embodiment of the present invention, there is provided a distributed traffic signal control method for a directed network comprising a plurality of junctions $J_i$, each junction $J_i$ having a plurality of links $L=\{L_1, \ldots, L_N\}$ connected thereto $J_i$, the links $L=\{L_1, \ldots, L_N\}$ comprising one or more upstream links (e.g., $L_1$, and $L_4$ in FIG. 2(*a*) below) and one or more downstream links (e.g., $L_5$ and $L_8$ in FIG. 2(*a*) below). In a broad aspect, the method comprises activating one of a plurality of phases of the junction for a predetermined time period which maximizes the directed network throughput based on current differential traffic backlogs between said one or more upstream links and said one or more downstream links connected to the junction $J_i$, each phase providing a unique combination of traffic signals at the junction $J_i$ for guiding traffic from said one or more upstream links to said one or more downstream links. Preferably, each current differential traffic backlog is determined based on a difference between a current traffic condition of one of the downstream links and a current traffic condition of one of the upstream links. For example, the current traffic condition comprises a queue length of vehicles at the link.

In a preferred embodiment, the above-mentioned one of a plurality of phases is activated based on the current differential traffic backlogs and a flow rate of traffic through the junction $J_i$. For example, the flow rate of traffic through the junction may be determined based on a comparison of a current traffic state at the junction with a prior model or data so as to locate a predetermined flow rate corresponding to the current traffic state. Alternatively, the flow rate is measured by a traffic monitoring system at the junction. For each phase, a parameter is determined based on a sum of the multiplication of the current differential traffic backlog with the flow rate of traffic for each unique combination of one upstream link and one downstream link of the plurality of links connected to the junction. Thereafter, one or more phases having a largest value is determined and one of the one or more phases having the largest value is activated for providing a unique combination of traffic signals at the junction $J_i$ for guiding traffic which maximizes the directed network throughput.

An exemplary embodiment of the above-described method is illustrated in FIG. 1. The method 100 comprises a first step 102 of determining a current differential traffic backlog between a downstream link and an upstream link for each unique combination of one upstream link and one downstream link of the plurality of links connected to the junction. Thereafter, step 104 determines a flow rate of traffic through the junction for each unique combination of one upstream link and one downstream link. In step 106, for each phase, a parameter is determined based on a sum of the multiplication of the current differential traffic backlog with the flow rate of traffic for each unique combination of one upstream link and one downstream link of the plurality of links. Then, in step 108, one or more phases having the parameter with a largest value is determined. Then, in step 110, selecting one of said one or more phases having the parameter with the largest value as the phase to be activated for the junction which maximizes the directed network throughput.

In another exemplary embodiment, there is provided a traffic signal controller for a directed network comprising a plurality of junctions, each junction having a plurality of links connected thereto, the links comprising one or more upstream links and one or more downstream links, the controller comprising a control unit for activating one of a plurality of phases of the junction for a predetermined time period which maximizes the directed network throughput based on current differential traffic backlogs between said one or more upstream links and said one or more downstream links connected to the junction, each phase providing a set of traffic signals at the junction for guiding traffic from said one or more upstream links to said one or more downstream links.

The traffic signal controller can be implemented in a traffic control system for a directed network. In this case, the traffic signal controller may comprise one or more traffic signal controllers as described above for directing traffic through one or more junctions in the directed network; and one or more traffic monitoring units for monitoring current traffic condition at one or more links and providing data indicative of the current traffic condition at said one or more links to the traffic signal controllers. By way of example only, the traffic monitoring unit may be a video monitoring unit or an inductive-loop traffic detector.

For clarity, specific examples of the present invention will now be described in detail. However, it will be appreciated to a person skilled in the art that the scope of the present invention is not limited to the specific examples described.

Figure 2:
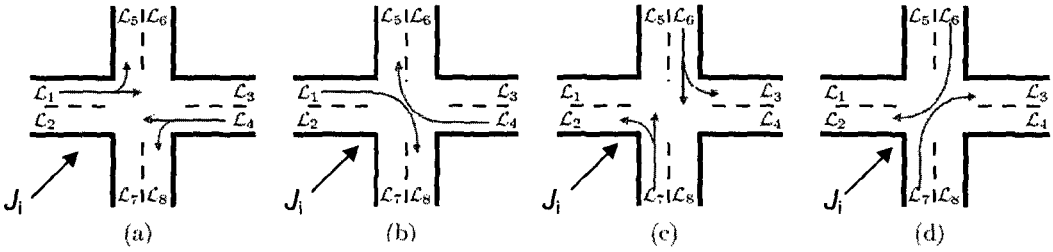
FIGS. 2(*a*)-(*d*) illustrate a typical set $\{P_1, P_2, P_3, P_4\}$ of phases of a junction with 4 approaches and 8 links.

FIGS. 2(*a*)-(*d*) illustrate a typical set $\{P_1, P_2, P_3, P_4\}$ of phases of a junction with 4 approaches and 8 links. Each junction $J_i$ comprises links $L_1, \ldots, L_8$. Here, $P_1=\{(L_1,L_8), (L_1,L_5)(L_4,L_2)(L_4,L_8)\}$, (b) $P_2=\{(L_1,L_8),(L_4,L_5)\}$, (c) $P_3=\{(L_7,L_5), (L_7,L_2)(L_6,L_8)(L_6,L_3)\}$, and (d) $P_4=\{(L_7, L_2),(L_6, L_2)\}$.

It is then assumed that the traffic signal system operates in slotted time $t\in N$. During each time slot, vehicles may enter the network at any link. Let $\lambda_a$ be the time average rate in which the number of new vehicles exogenously enter the network at link $L_a$, $L_a\in\{1, \ldots, N\}$ during each time slot it is admissible. Let $\lambda=[\lambda_a]$ represent the arrival rate vector. At the beginning of each time slot, the traffic signal controller determines the phase for each junction to be activated during this time slot. For each $a\in\{1, \ldots, N\}$, $i\in\{1, \ldots, L\}$, $t\in N$, let $Q_a(t)\in N$ and $z_i(t)\in Z_i$ represent the number of vehicles on $L_a$ and the traffic state around $J_i$, respectively, at the beginning of time slot t. In addition, for each $i\in\{1, \ldots, L\}$, a function $\xi_i$: $P_i\times M_i\times Z_i\rightarrow N$ is defined such that $\xi_i(p_i,L_a,L_b)$ gives the rate (i.e., the number of vehicles per unit time) at which vehicles that can go from $L_a$ to $L_b$ through junction $J_i$ under traffic state $z_i$ if phase $p_i$ is activated. By definition, $\xi_i(p_i,L_a,L_b,z_i)=0$, $\forall z\in Z_i$ if $(L_a,L_b)\notin p_i$, i.e., if phase $p_i$ does not give the right of way to the traffic movement from $L_a$ to $L_b$. When the traffic state $z_i$ represents the case where the number of vehicles on $L_a$ that seek movement to $L_b$ through $J_i$ is large, $\xi_i(p_i,L_a,L_b,z_i)$ can be simply obtained by assuming saturated flow.

Based on the above, embodiments of the present invention seek to provide a traffic signal controller that determines the phase $p_i(t)\in P_i$ for each junction $J_i$, $i\in\{1, \ldots, L\}$ to be activated during each time slot $t\in N$ such that the network throughput is maximized. It is assumed that that there exists a reliable traffic monitoring system (e.g. cameras, buried induction loop vehicle detectors, in-vehicle units, etc) that provides a measurement, or an estimate, of the queue length $Q_a(t)$ and traffic state $z_i(t)$ for each $a\in\{1, \ldots, N\}$, $i\in\{1, \ldots, L)\}$ at the beginning of each time slot $t\in N$ to the controller. The traffic signal controller is advantageously implemented in a distributed manner in the sense that the traffic signal controller at each junction can be run independently from other junctions, requiring only the measure of queue length $Q_a(t)$ on the roads that connect to that junction and the current traffic state $z_i(t)$ around the junction.

In an example embodiment, a pseudo-code suitable for implementation is as follows:

Traffic Signal Control Algorithm for Junction $J_i\in J$

Input:

$M_i$ is the set of all the possible traffic movements through $J_i$, $P_i\subseteq 2^{M_i}$: the set of all possible phases of $J_i$, $Z_i$: the set of traffic states around $J_i$.

$\xi_i$: the flow rate function of $J_i$.

For each time slot t=0, 1, 2, . . .

Obtain $z_i(t)$ and $Q_a(t)$ from a traffic monitoring system for each link $L_a$ that enters or exits $J_i$ (i.e., $(L_a,L_b)\in M_i$ or $(L_b,L_a)\in M_i$ for some $L_b\in L$);

Compute $W_{ab}(t)$ as defined in equation (1) below for each $(L_a,L_b)\in M_i$;

Compute $S_p(t)$ as defined in equation (2) below for each $p\in P_i$;

Pick $p^*\in P_i$ such that $S_{p^*}\geq S_p$, $\forall p\in P_i$

Activate phase $p_i(t)=p^*$ for time slot t;

Wait until the end of time slot t;

endfor

At the beginning of time slot t, for each junction $J_i\in J$, first compute $$W_{ab}(t)=Q_a(t)-Q_b(t)_i \tag{1}$$

for each pair $(L_a,L_b)\in M_i$. Then, for each phase $p\in P_i$, compute:

$$S_p(t) = \sum_{(\mathcal{L}_a,\mathcal{L}_b)\in p} W_{ab}(t)\xi_i(p, \mathcal{L}_a, \mathcal{L}_b, z_i(t)). \quad (2)$$

The controller for junction $J_i$ then activates phase $p^*\in P_i$ such that $S_{p^*}\geq S_p$, $\forall p\in P_i$ during the time slot t (If there exist multiple options of p* that satisfy the inequality, the controller can pick any one arbitrarily). Since the number of possible phases for each junction is typically small (<10), the above computation and enumeration through all the possible phases can be practically performed in real time.

The basic properties of the traffic signal control algorithm according to embodiments of the present invention are formally stated in lemma 1 below.

Lemma 1:

Consider an arbitrary time slot $t\in N$. Let $z(t)\in Z_1\times \ldots, Z_L$ be a vector of traffic states of all the junctions during time slot t. For each $i\in\{1, \ldots, L\}$, let $p_i(t)$ and $\bar{p}_i(t)$ be the phase of junction $J_i$ during time slot t as determined by the traffic signal control algorithm described above and any other algorithm, respectively. Then, for any $z(t)\in Z_1\times \ldots, Z_L$, $$\sum_a Q_a(t)\left(\sum_{\substack{b,i\ s.t.\\(\mathcal{L}_a,\mathcal{L}_b)\in M_i}} \xi_i(\tilde{p}_i(t), \mathcal{L}_a, \mathcal{L}_b, z_i(t)) - \sum_{\substack{c,i\ s.t.\\(\mathcal{L}_c,\mathcal{L}_a)\in M_i}} \xi_i(\tilde{p}_i(t), \mathcal{L}_c, \mathcal{L}_a, z_i(t))\right) \leq$$

$$\sum_a Q_a(t)\left(\sum_{\substack{b,i\ s.t.\\(\mathcal{L}_a,\mathcal{L}_b)\in M_i}} \xi_i(p_i(t), \mathcal{L}_a, \mathcal{L}_b, z_i(t)) - \sum_{\substack{c,i\ s.t.\\(\mathcal{L}_c,\mathcal{L}_a)\in M_i}} \xi_i(p_i(t), \mathcal{L}_c, \mathcal{L}_a, z_i(t))\right)$$

where for each $i\in\{1, \ldots, L\}$, $z_i(t)$ is the element of z(t) that corresponds to the traffic state of junction $J_i$.

Besides offering superior network performance based on standard measures such as queue length, delay and number of stops, key advantages of embodiments of the present invention over existing traffic signal control algorithms include:

1. Ease of implementation: As opposed to other systems, such as SCATS where each junction needs to be identified as critical or non-critical and all the possible split plans need to be pre-specified and tuned based on the characteristics of the traffic on the network, the method according to embodiments of the present invention treats all the junctions exactly the same and does not require a pre-defined set of all the possible split plans.

2. Robustness: The method according to embodiments of the present invention does not rely on a pre-defined set of split plans and an identification of critical junctions, and accordingly it is more robust to changes in the characteristics of the traffic and the network, including changes in the origin-destination pairs (e.g., when a new structure is introduced to the network or an important event occurs), and changes in the road conditions.

3. Computational simplicity: As opposed to existing optimization-based techniques where a large optimization problem needs to be solved, considering the complete network, the method according to embodiments of the present invention only requires a simple algebraic computation, using only local information.

The performance of the traffic signal controller according to embodiments of the present invention is evaluated as follows:

Let $\Lambda$ be the capacity region of the road network. Assume that $z(t)=[z_i(t)]$ evolves according to a finite state, irreducible, aperiodic Markov chain. Let $\pi_z$ represent the time average fraction of time that z(t)=z, i.e., with probability 1, to have $\lim_{t\to\infty} 1/t\Sigma_{\tau=0}^{t-1} 1_{[z(\tau)=z]}=\pi_z$: for all $z\in Z_1\times \ldots \times Z_L$ where $1_{[z(\tau)=z]}$ is an indicator function that takes the value 1 if $z(\tau)=z$ and takes the value 0 otherwise. In addition, let $M=\cup_i M_j$ be the set of all the possible traffic movements. For sake of simplicity of presentation, it is assumed that $M_i\cap M_j=\emptyset$ for all $i\neq j$. For each $p\in P_1\times \ldots \times P_L$, $z\in Z_1\times \ldots \times Z_L$, a vector $\xi(p, z)$ is defined whose $k^{th}$ element is equal to $\xi_i(p_i, R_a, R_b, z_i)$ where $(R_a, R_b)$ is the $k^{th}$ traffic movement in M, $(R_a, R_b)\in M_i$ and $p_i$ and $z_i$ are the $i^{th}$ element of p and z, respectively. Thereafter, define $\Gamma$, $$\Gamma \triangleq \sum_{z\in\mathcal{Z}_1\times \ldots \times\mathcal{Z}_L} \pi_z Conv\{[\xi(p, z)] \mid p \in \mathcal{P}_1\times \ldots \times\mathcal{P}_L\}.,$$

which is used in lemma 2 below.

Additionally, it is assumed that the process of vehicles exogenously entering the network is rate ergodic and for all $a\in\{1, \ldots, N\}$, there are always enough vehicles on $R_a$ such that for all $i\in\{1, \ldots, L\}$, $b\in\{1, \ldots, N\}$, $p_i\in P_i$, $z_i\in Z_i$, vehicles can move from $R_a$ to $R_b$ at rate $\xi_i(p_i, R_a, R_b, z_i)$.

Before deriving the optimality result for the traffic signal control algorithm according to embodiments of the present invention, the capacity region of the road network is first characterized, as formally stated in the lemma 2 below.

Lemma 2

The capacity region of the network is given by the set $\Lambda$ consisting of all the rate vectors $\lambda$ such that there exists a rate vector $G\in\Gamma$ together with flow variables $f_{ab}$ for all $a,b\in\{1, \ldots, N\}$ satisfying $$f_{ab}\geq 0,\ \forall a,b\in\{1, \ldots ,N\},$$

$$\lambda_a=\Sigma_b f_{ab}-\Sigma_c f_{ca},\ \forall a\in\{1, \ldots ,L\},$$

$$f_{ab}=0,\ \forall a,b\in\{1, \ldots ,N\} \text{ such that } (L_a,L_b)\notin M,$$

$$f_{ab}G_{ab},\ \forall a,b\in\{1, \ldots ,N)\} \text{ such that } (L_a,L_b)\in M,$$

where $G_{ab}$ is the element of G that corresponds to the rate of traffic movement $(R_a, R_b)$.

Based on the above, the following corollary may be formulated:

Corollary 1

If z(t) is i.i.d. from slot to slot, then $\lambda$ is within the capacity region $\Lambda$ if and only if there exists a stationary randomized control algorithm that makes phase decisions based only on the current traffic state z(t), and that yields for all $a\in\{1, \ldots, N\}$, $t\in\{0, 1, 2 \ldots\}$, $$\mathbb{E}\left\{\sum_{\substack{b,i\ s.t.\\(\mathcal{L}_a,\mathcal{L}_b)\in M_i}} \xi_i(\hat{p}_i(t), \mathcal{L}_a, \mathcal{L}_b, z_i(t)) - \sum_{\substack{c,i\ s.t.\\(\mathcal{L}_c,\mathcal{L}_b)\in M_i}} \xi_i(\hat{p}_i(t), \mathcal{L}_c, \mathcal{L}_b, z_i(t))\right\} = \lambda_a,$$

where the expectation is taken with respect to the random traffic state z(t) and the (potentially) random control action based on this state.

Based on the above corollary and the basic property of the traffic signal control algorithm according to embodiments of the present invention, it can be concluded that the traffic signal control algorithm described above leads to maximum network throughput.

Further, the following theorem may be derived:

Theorem 1

If and there exists as $\in>0$ such that $\lambda+\in\in\forall$, then the traffic signal controller according to embodiments of the present invention stabilizes the network, provided that z(t) is i.i.d. from slot to slot.

To further evaluate the performance of the traffic signal control method according to embodiments of the present invention (in comparison with a SCATS-like system), two scenarios were considered.

The first scenario considered a single junction where all the links have infinite queue capacity. A macroscopic simulation was performed in MATLAB. In the second scenario, a microscopic traffic simulator MITSIMLab was used. A medium size road network was considered. The performance of both algorithms was evaluated based on different measures, including queue length, delay and number of stops.

Scenario 1

Figure 3:
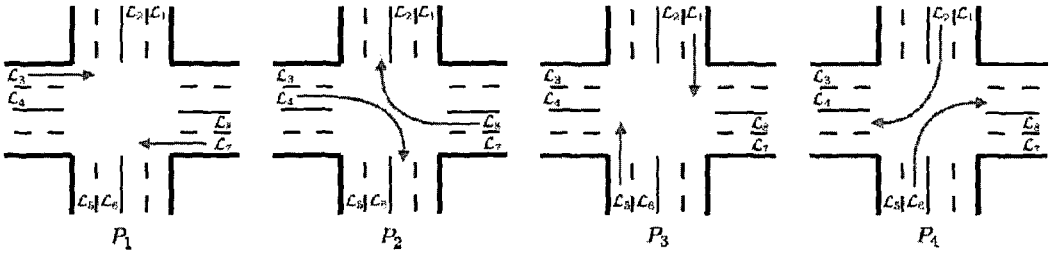
FIG. 3 shows an illustration of a 4-phase junction with 4 approaches and 8 links.

The traffic signal controller was implemented in a 4-phase junction with 4 approaches and 8 links, as shown in FIG. 3. Vehicles exogenously entering each of the 8 links are simulated based on the data collected from induction loop detectors installed at the junction. The maximum output rate of each lane is assumed to be 4 times of the maximum arrival rate of that lane.

The parameters used in the SCATS-like system are obtained from: D. Liu, "Comparative evaluation of dynamic TRANSYT and SCATS-based signal control systems using Paramics simulation," Master's thesis, National University of Singapore, 2003, with the possible split plans as shown in Table I below. The standard space time under saturated flow for each vehicle is assumed to be 1.5 seconds. The maximum, minimum and medium cycle lengths are set to 140 seconds, 60 seconds and 100 seconds, respectively. The degrees of saturation that result in the maximum, minimum and medium cycle lengths are assumed to be 0.9, 0.3 and 0.5, respectively. Finally, the split plan is computed based on the vote from the last 5 cycles.

TABLE 1

Possible split plans for the SCATS-like implementation in the MATLAB simulation

| Plan | 1 | 2 | 3 | 4 | 5 |
|---|---|---|---|---|---|
| Phase $P_1$ | 30% | 20% | 35% | 35% | 20% |
| Phase $P_2$ | 30% | 35% | 35% | 30% | 35% |
| Phase $P_3$ | 20% | 20% | 20% | 10% | 25% |
| Phase $P_4$ | 20% | 25% | 10% | 25% | 20% |

The queue length on each link a evolves as follows:

$$Q_a(t+1)=Q_a(t)+I_a(t)-I_a^{\pi}(Q_a(t),I_a(t),R_a(t)),$$

where $I_a(t)$ is the number of vehicles arriving at link a during time slot t and $I_a^{\pi}$ is a function that describes the number of passing vehicles and is given by:

$$I_a^{\pi}(Q_a(t),\ I_a(t),\ R_a(t)) = R_a(t)\left(1 - e^{\frac{-(Q_a(t)+I_a(t))}{R_a(t)}}\right). \quad (3)$$

Here, $R_a(t)=S_a(t)g_a(t)$ is the maximum number of passing vehicles where $S_a(t)$ is the saturation flow and $g_a(t)$ is the green time for link a.

Figure 4:
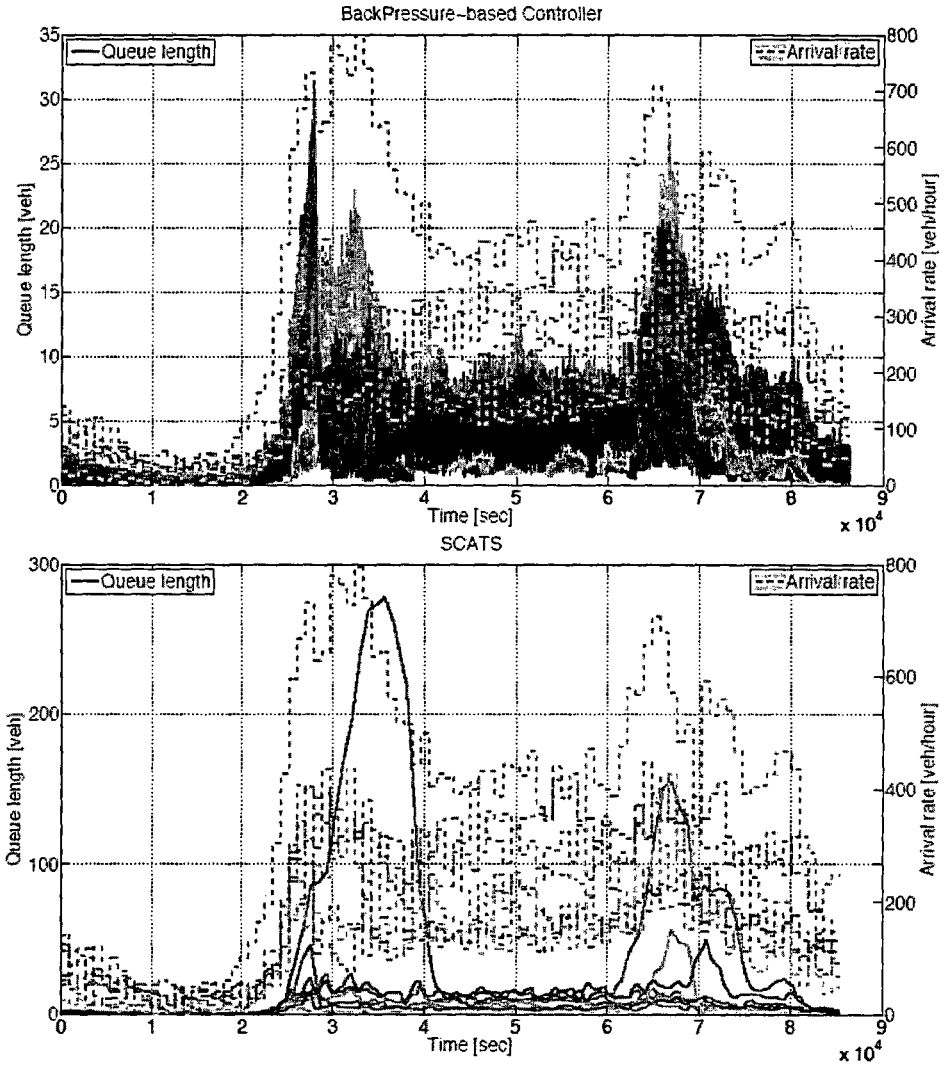
FIG. 4 shows the simulation results indicating the arrival rate (dashed line) and the resulting queue length (solid line) of each lane when (top) the distributed traffic signal control method according to embodiments of the present invention ("backpressure-based controller") and (bottom) a SCATS-like system are applied.
Figure 5:
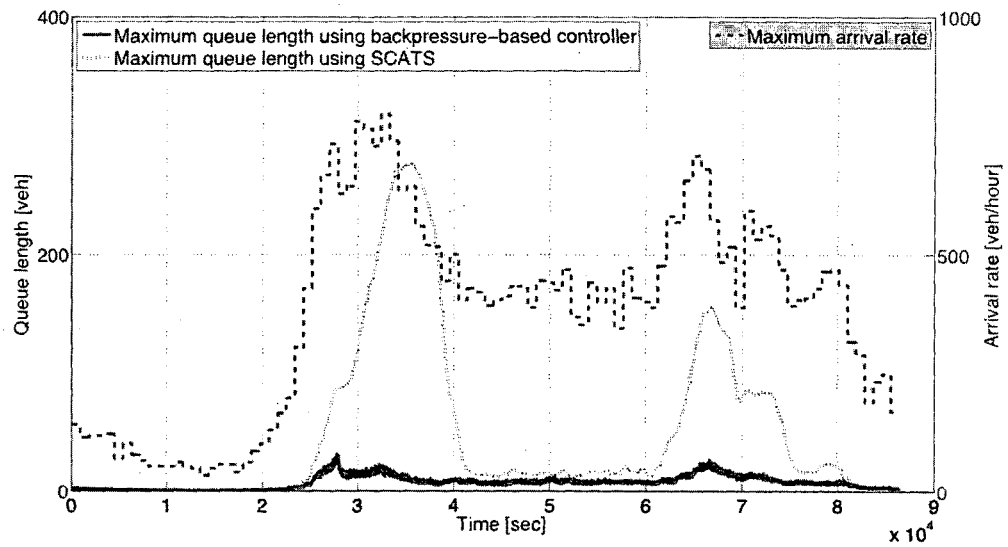
FIG. 5 shows the maximum arrival rate and the maximum queue length over all the lanes when the distributed traffic signal control method according to embodiments of the present invention and a SCATS-like system are applied.

FIG. 4 shows the simulation results indicating the arrival rate (dashed line) and the resulting queue length (solid line) of each lane when (top) the distributed traffic signal control method according to embodiments of the present invention ("backpressure-based controller") and (bottom) the SCATS-like system are applied. Here, it is assumed that all the links have infinite queue capacity. These simulation results show that the distributed traffic signal control method according to embodiments of the present invention can advantageously reduce the maximum queue length by an order of magnitude, compared to the SCATS-like system, as shown in FIG. 5. FIG. 5 shows the maximum arrival rate and the maximum queue length over all the lanes when the distributed traffic signal control method according to embodiments of the present invention and the SCATS-like system are applied.

Figure 6:
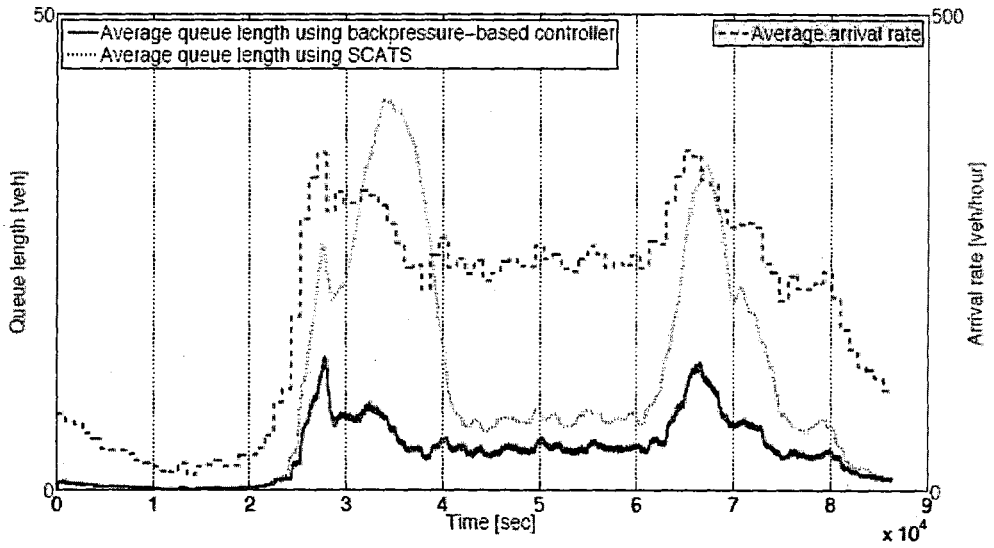
FIG. 6 shows the average arrival rate and the average queue length over all the lanes when the distributed traffic signal control method according to embodiments of the present invention and a SCATS-like system are applied.

FIG. 6 shows the average arrival rate and the average queue length over all the lanes when the distributed traffic signal control method according to embodiments of the present invention and the SCATS-like system are applied, which indicates that the distributed traffic signal control method performs significantly better on average.

Figure 7:
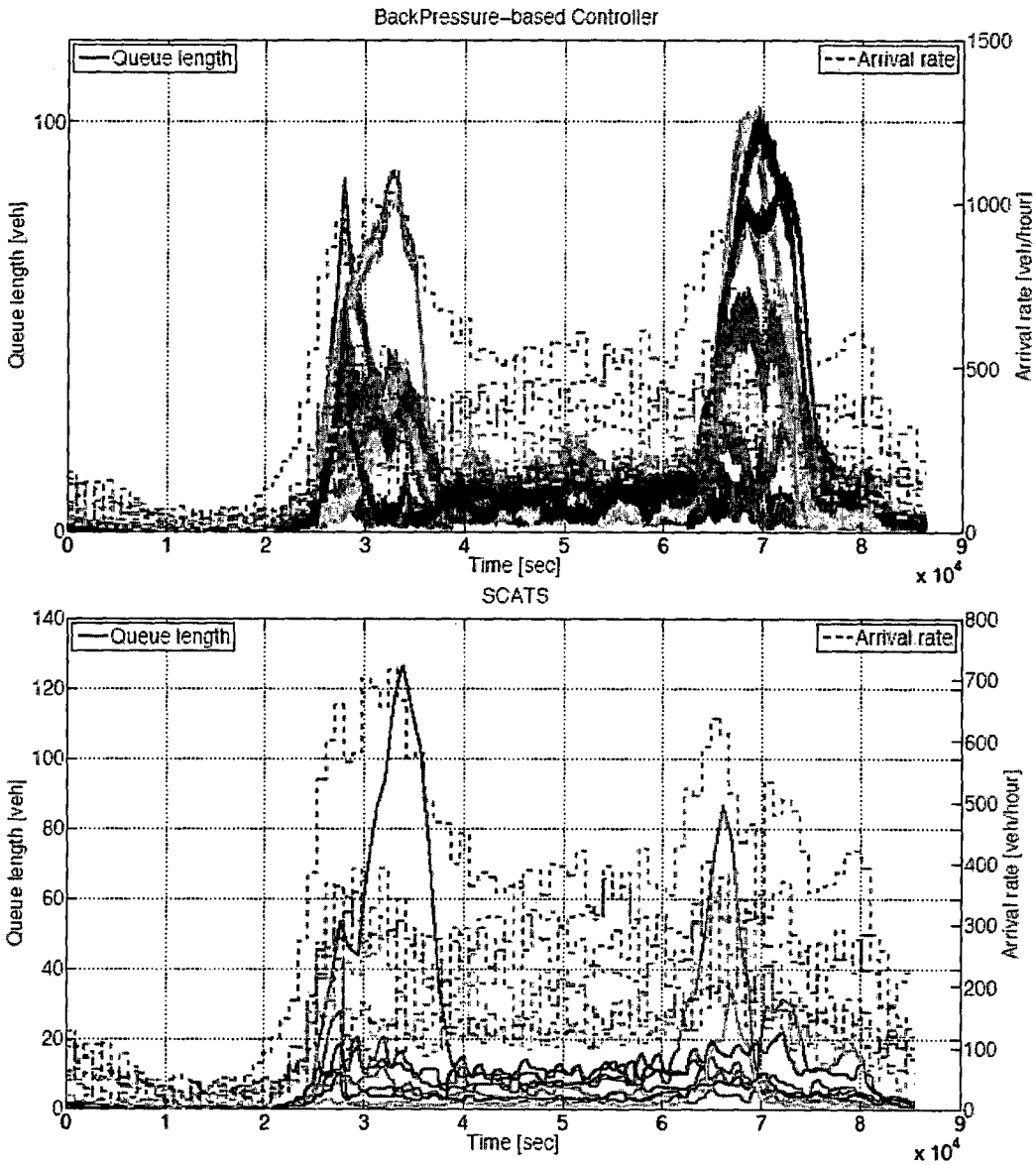
FIG. 7 shows the simulation results indicating the queue length (solid line) when (top) the distributed traffic signal control method according to embodiments of the present invention ("backpressure-based controller") is applied with the vehicle arrival rate (dashed line) that is 1.3 times of the current value and (bottom) a SCATS-like system is applied with the vehicle arrival rate (dashed line) that is 0.9 times of the current value.

Supposing each link can actually accommodate only 100 vehicles, FIG. 7 shows the simulation results indicating the queue length (solid line) when (top) the distributed traffic signal control method according to embodiments of the present invention ("backpressure-based controller") is applied with the vehicle arrival rate (dashed line) that is 1.3 times of the current value and (bottom) the SCATS-like system is applied with the vehicle arrival rate (dashed line) that is 0.9 times of the current value.

The relatively poorer performance of the SCATS-like system may largely result from insufficient choices of possible split plans as there is no split plan that allocates more than 35% of cycle length to some phases. Hence, even though there is a high demand only for a certain traffic movement as typically observed during the peak hours, a large percentage of cycle length is still allocated to other phases. In contrast, the distributed traffic signal control method according to embodiments of the present invention is able to allocate more than 35% of cycle length to some phases.

Scenario 2

Figure 8:
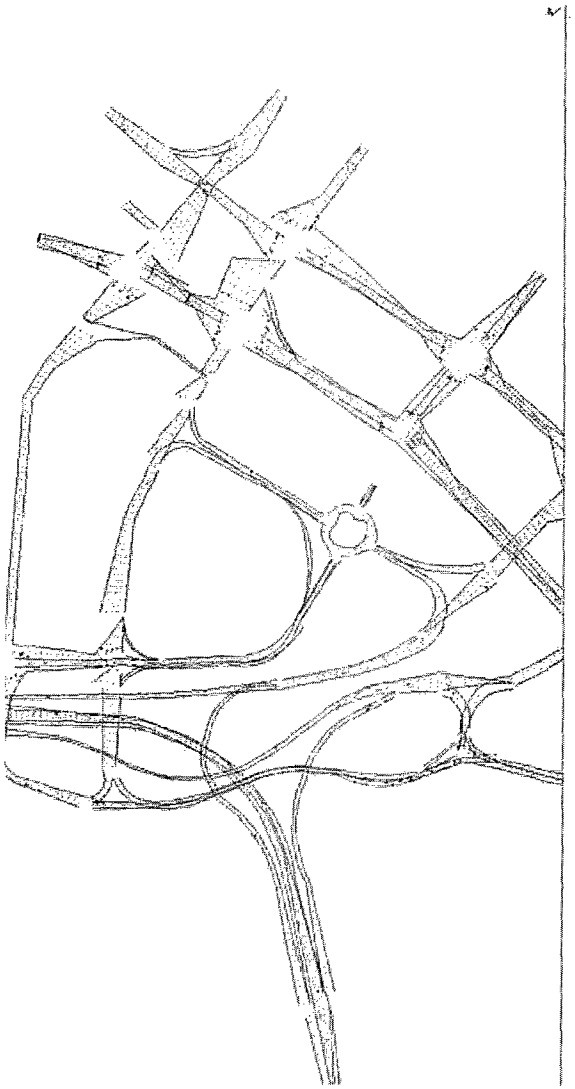
FIG. 8 shows a schematic of a road network with 112 links and 14 signalized junctions.

A microscopic traffic simulator MITSIMLab is used to evaluate the distributed traffic signal control method according to embodiments of the present invention. A road network with 112 links and 14 signalized junctions, as schematically shown in FIG. 8, is considered. Vehicles exogenously enter and exit the network at various links based on 45 different origin-destination pairs, with the total arrival rate of 9330 vehicles/hour. For the SCATS-like system implementation, the number of possible split plans for each junction ranges from 5 to 17. The standard space time under saturated flow for each vehicle is assumed to be 0.96 seconds. The other parameters are the same as those used in the previous scenario. In this scenario, the flow rate function, which is used in the distributed traffic signal control method according to embodiments of the present invention, is derived from the macroscopic model in equation (3) above. Hence, it may not accurately provide the flow rate through the corresponding junction due to a possible mismatch between the macroscopic model in equation (3) and the microscopic model used in MITSIMLab. In addition, as opposed to the previous scenario, all the links have finite queue capacity in this case.

Figure 9:
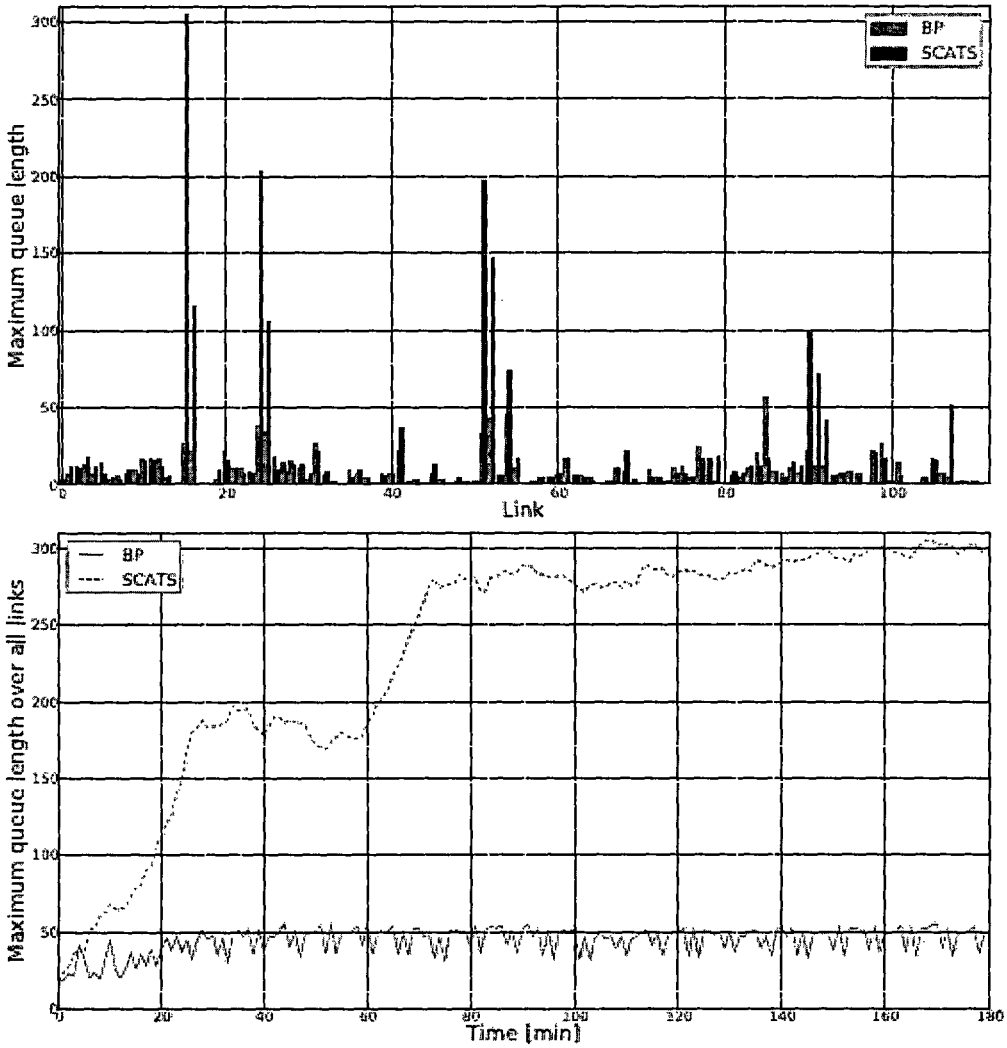
FIG. 9 shows the simulation results indicating maximum queue length when a SCATS-like system and the distributed traffic signal control method according to embodiments of the present invention ("BP") are used.
Figure 10:
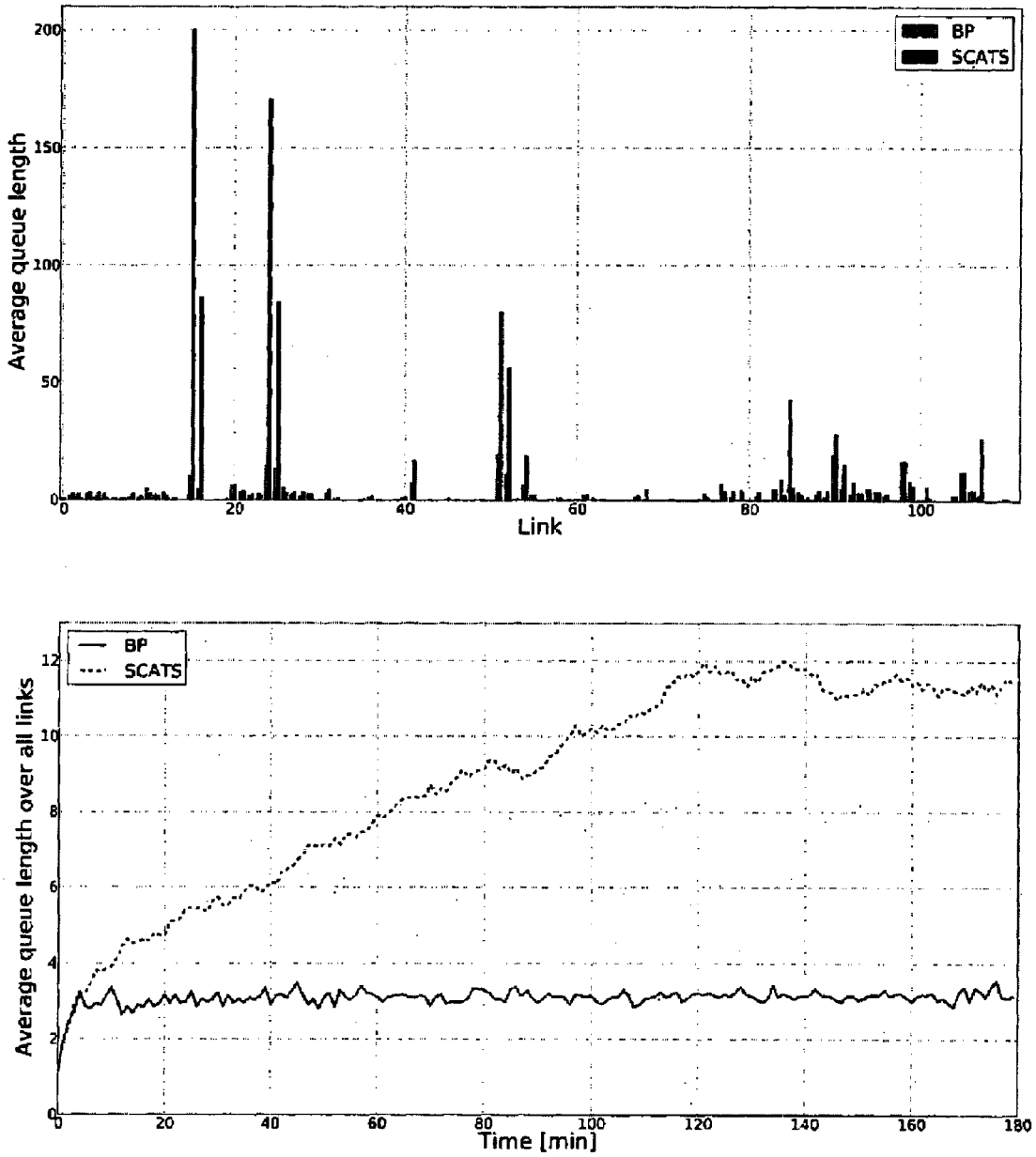
FIG. 10 shows the simulation results indicating average queue length when a SCATS-like system and the distributed traffic signal control method according to embodiments of the present invention ("BP") are used.
Figure 11:
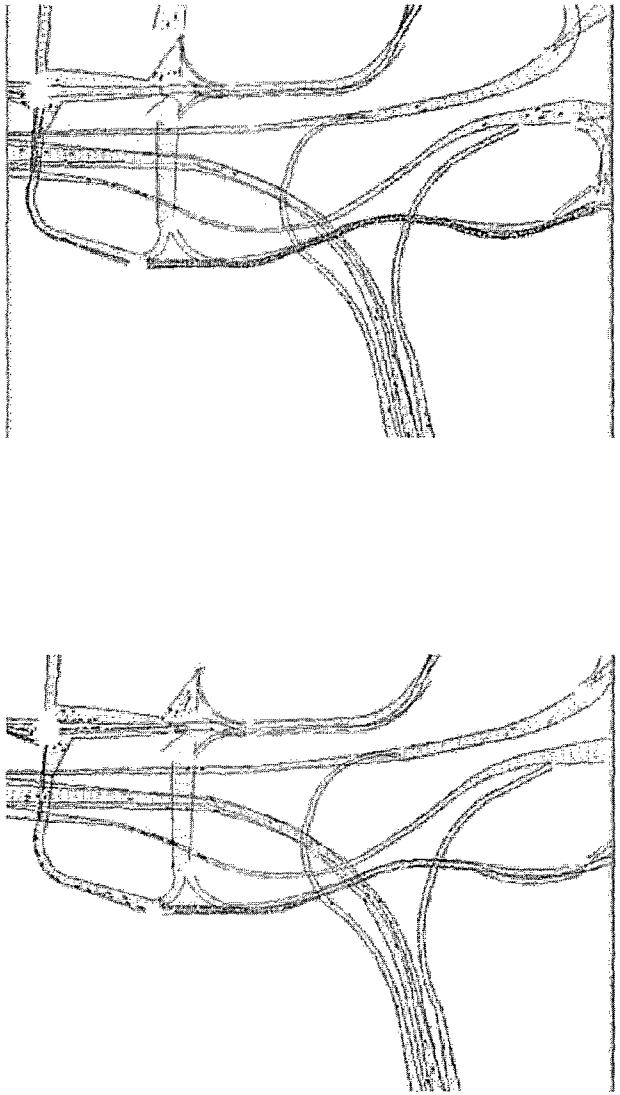
FIG. 11 (left) is a schematic of a road network showing traffic queues when a SCATS-like system is used, and FIG. 10 (right) is a schematic of a road network showing traffic queues when the distributed traffic signal control method according to embodiments of the present invention is used.

The maximum and average queue lengths are shown in FIG. 9 and FIG. 10, respectively. These simulation results show that the distributed traffic signal control method according to embodiments of the present invention can reduce the maximum queue length by a factor of 5, compared to the SCATS-like system. In addition, the distributed traffic signal control method according to embodiments of the present invention performs significantly better than the SCATS-like system on average, reducing the average queue length from approximately 8.8 to 3.1. FIG. 11 (left) is a schematic of a portion of the road network showing queues spreading over multiple links upstream when the SCATS-like system is used, and FIG. 11 (right) is a schematic of a portion of the road network showing that the queues do not spread over as many links when the distributed traffic signal control method according to embodiments of the present invention is used.

One of the reasons that the difference in the queue length when the distributed traffic signal control method according to embodiments of the present invention and the SCATS-like system are applied is not as significant as in the previous single-junction scenario is because in this scenario, each link has finite capacity. Hence, the number of vehicles on each link is limited by the link capacity and therefore queue length on each link cannot grow very large.

Figure 12:
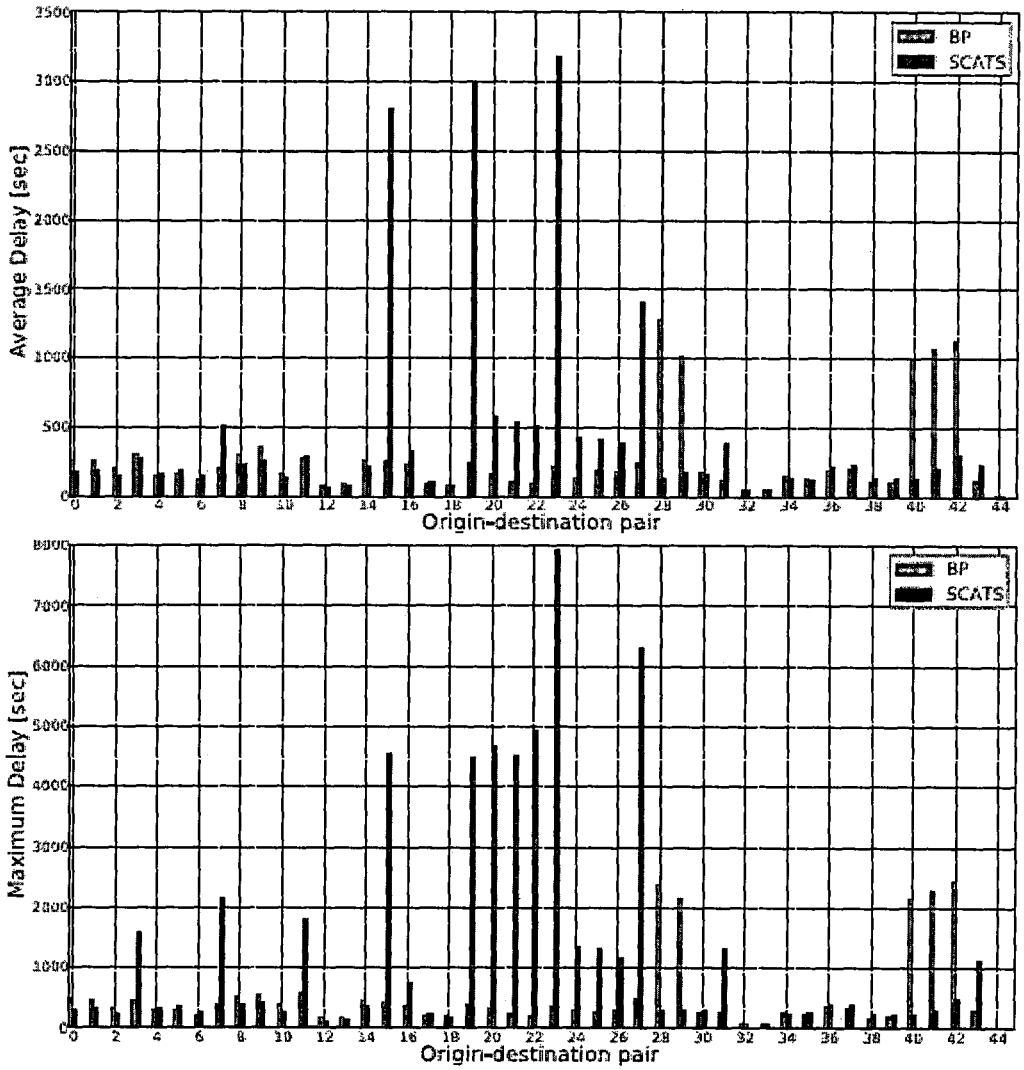
FIG. 12 shows simulation results indicating (top) average delay and (bottom) maximum delay for each origin-destination pair when a SCATS-like system and the distributed traffic signal control method according to embodiments of the present invention ("BP") are used.

FIG. 12 shows simulation results indicating (top) average delay and (bottom) maximum delay for each origin-destination pair when the SCATS-like system and the distributed traffic signal control method according to embodiments of the present invention ("BP") are used. When the SCATS-like system and the distributed traffic signal control method according to embodiments of the present invention are used, the average delay over all the vehicles is computed to be approximately 277 and 172 seconds, respectively, whereas the maximum delay is 7954 and 2430 seconds, respectively. The simulation results shows that the distributed traffic signal control method according to embodiments of the present invention can reduce the average and maximum delay by approximately 38% and 69%, respectively, compared to the SCATS-like system.

Figure 13:
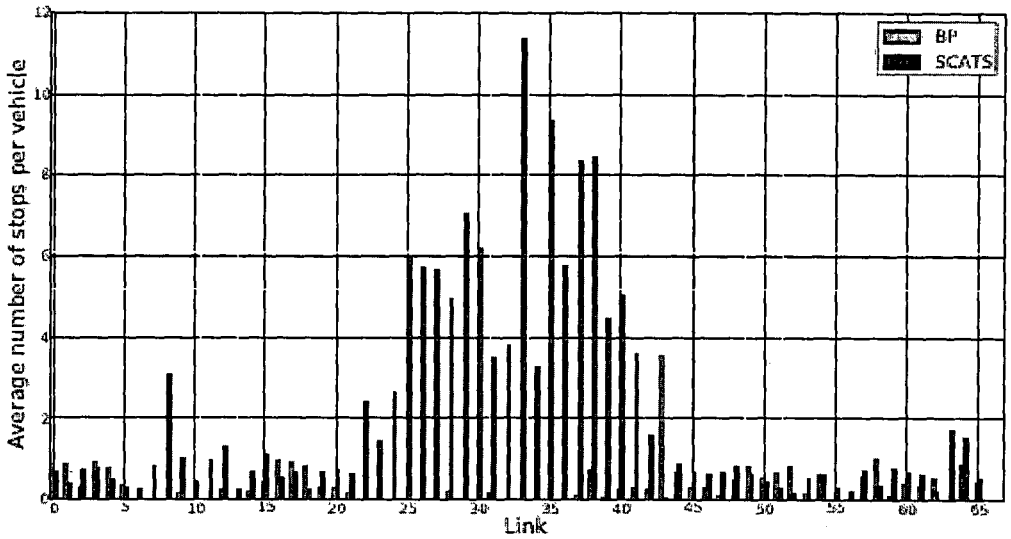
FIG. 13 shows the simulation results indicating the average number of stops per vehicle on each link, when a SCATS-like system and the distributed traffic signal control method according to embodiments of the present invention ("BP") are used.

Finally, the average number of stops per vehicle on each link, when the SCATS-like system and the distributed traffic signal control method according to embodiments of the present invention ("BP") are used, is shown in FIG. 13. The average number of stops per vehicle is approximately 7 and 1 for the case where the SCATS-like system and the distributed traffic signal control method according to embodiments of the present invention are used, respectively. This shows that even though the distributed traffic signal control method according to embodiments of the present invention is completely distributed and does not explicitly enforce the coordination among the traffic light controllers at neighboring junctions, a green wave can be achieved.

SUMMARY

The locally distributed traffic signal controllers according to embodiments of the present invention are constructed and implemented independently of one another. Furthermore, each local controller does not require the global view of the road network. Instead, the controllers only require information that is local to the junction with which it is associated. It is shown above that the distributed traffic signal control method according to embodiments of the present invention leads to maximum network throughput even though the controller is constructed and implemented in such a distributed manner and no information about traffic arrival rates is provided. Simulation results presented herein show that the distributed traffic signal control method according to embodiments of the present invention performs significantly better than the SCATS-like system.

Two scenarios were considered, a single junction (FIG. 3) and a medium-size road network (FIG. 8). In both scenarios, simulation results show the distributed traffic signal control method according to embodiments of the present invention performs significantly better than the SCATS-like system. In the first scenario, the distributed traffic signal control method according to embodiments of the present invention was able to reduce the maximum and average queue length by an order of magnitude and a factor of 3, respectively, compared to the SCATS-like system. In the second scenario, the maximum and average queue length was reduced by a factor of 5 and 3, respectively, when the distributed traffic signal control method according to embodiments of the present invention was used. Furthermore, the distributed traffic signal control method according to embodiments of the present invention is able to reduce the maximum and average delay by approximately 69% and 38%, respectively, and reduce the average number of stops per vehicle from 7 to 1. Besides offering superior network performance, key advantages of the distributed traffic signal control method according to embodiments of the present invention also include the ease of implementation, computational simplicity and robustness to changes in the traffic and network characteristics.

Figure 14:
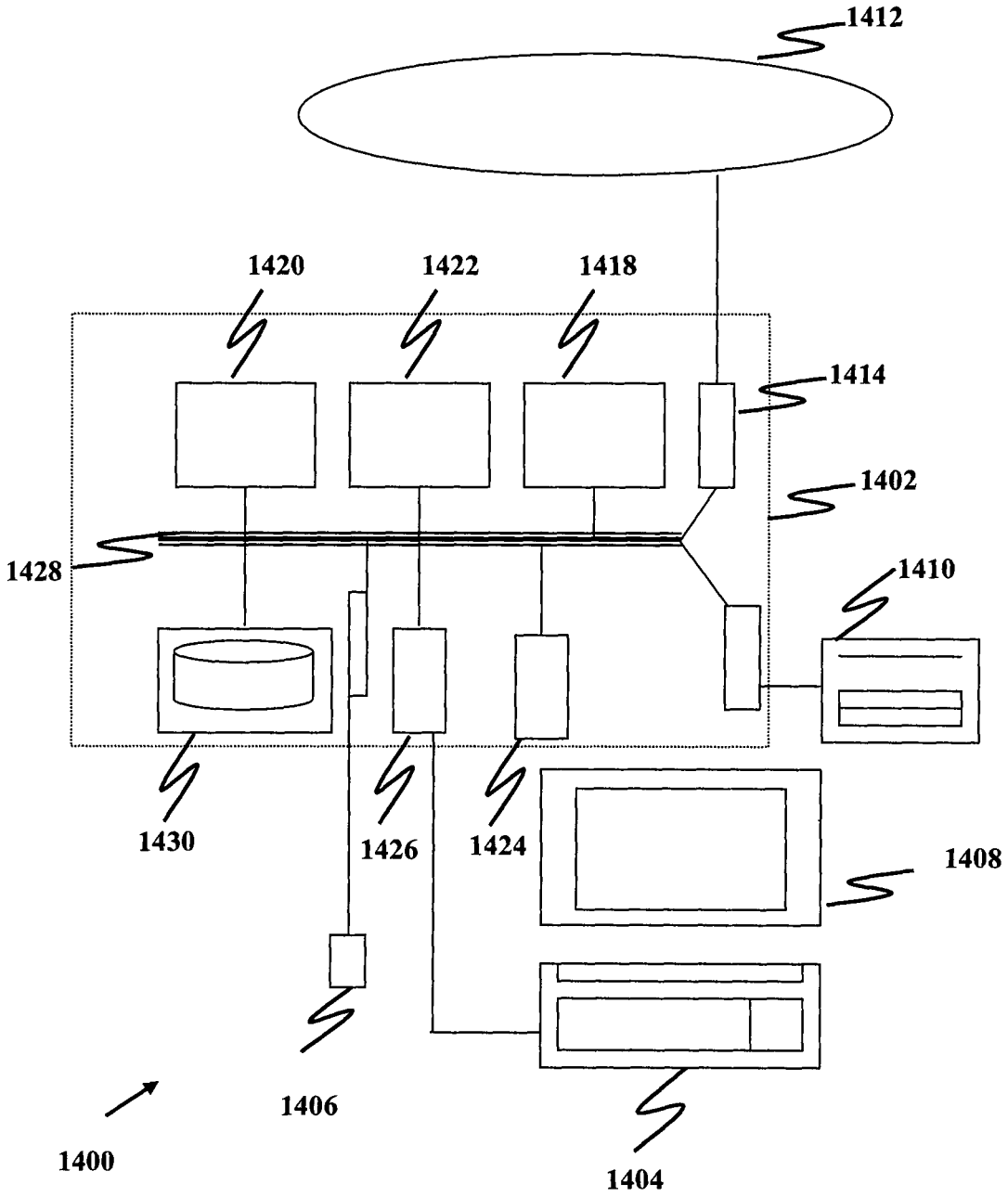
FIG. 14 is a schematic of a computer system for implementing the traffic signal control method in example embodiments.

The method and system (e.g., the traffic signal control method, traffic signal controller, and/or traffic control system as hereinbefore described) of the example embodiments described herein can be implemented on a computer system 1400, schematically shown in FIG. 14. It may be implemented as software, such as a computer program being executed within the computer system 1400, and instructing the computer system 1400 to conduct the method of the example embodiment.

The computer system 1400 comprises a computer module 1402, input modules such as a keyboard 1404 and mouse 1406 and a plurality of output devices such as a display 1408, and printer 1410.

The computer module 1402 is connected to a computer network 1412 via a suitable transceiver device 1414, to enable access to e.g. the Internet or other network systems such as Local Area Network (LAN) or Wide Area Network (WAN).

The computer module 1402 in the example includes a processor 1418, a Random Access Memory (RAM) 1420 and a Read Only Memory (ROM) 1422. The computer module 1402 also includes a number of Input/Output (I/O) interfaces, for example I/O interface 1424 to the display 1408, and I/O interface 1426 to the keyboard 1404.

The components of the computer module 1402 typically communicate via an interconnected bus 1428 and in a manner known to the person skilled in the relevant art.

The application program is typically supplied to the user of the computer system 1400 encoded on a data storage medium such as a CD-ROM or flash memory carrier and read utilising a corresponding data storage medium drive of a data storage device 1430. The application program is read and controlled in its execution by the processor 1418. Intermediate storage of program data maybe accomplished using RAM 1420.

It will be appreciated by a person skilled in the art that numerous variations and/or modifications may be made to the present invention as shown in the embodiments without departing from a spirit or scope of the invention as broadly described. The embodiments are, therefore, to be considered in all respects to be illustrative and not restrictive.

The invention claimed is:

1. A distributed traffic signal control method for a directed network comprising a plurality of junctions, each of the plurality of junctions having a plurality of links connected thereto, the links comprising one or more upstream links and one or more downstream links, the method comprising:

activating one of a plurality of phases of each of the plurality of junctions for a predetermined time period which maximizes the directed network throughput based on current differential traffic backlogs between said one or more upstream links and said one or more downstream links connected to each of the plurality of junctions, each phase providing a unique combination of traffic signals at each of the plurality of junctions for guiding traffic from said one or more upstream links to said one or more downstream links, wherein said activating one of a plurality of phases is based on said current differential traffic backlogs and a flow rate of traffic through each of the plurality of junctions; and determining, for each phase, a parameter based on a sum of the multiplication of the current differential traffic backlog with the flow rate of traffic for each unique combination of one upstream link and one downstream link of the plurality of links connected to each of the plurality of junctions.

2. The method according to claim 1, wherein each current differential traffic backlog is determined based on a difference between a current traffic condition of one of the downstream links and a current traffic condition of one of the upstream links.

3. The method according to claim 2, wherein the current traffic condition comprises a queue length of vehicles at the link.

4. The method according to claim 1, wherein the flow rate of traffic through each of the plurality of junctions is determined based on a comparison of a current traffic state at each of the plurality of junctions with a prior model or data so as to locate a predetermined flow rate corresponding to the current traffic state.

5. The method according to claim 1, wherein the flow rate is measured by a traffic monitoring system at each of the plurality of junctions.

6. The method according to claim 1, further comprises determining one or more phases having the parameter with a largest value, wherein said activating one of a plurality of phases comprises selecting one of said one or more phases having the parameter with the largest value.

7. The method according to claim 1, wherein the upstream link is a link for providing inflow of traffic to each of the plurality of junctions and the downstream link is a link for receiving outflow of traffic from each of the plurality of junctions.

8. A traffic signal controller for a directed network comprising a plurality of junctions, each of the plurality of junction having a plurality of links connected thereto, the links comprising one or more upstream links and one or more downstream links, the controller comprising:

a control unit for activating one of a plurality of phases of each of the plurality of junctions for a predetermined time period which maximizes the directed network throughput based on current differential traffic backlogs between said one or more upstream links and said one or more downstream links connected to each of the plurality of junctions, each phase providing a set of traffic signals at each of the plurality of junctions for guiding traffic from said one or more upstream links to said one or more downstream links, wherein the control unit is operable to activate said one of a plurality of phases based on said current differential traffic backlogs and a flow rate of traffic through each of the plurality of junctions; and wherein for each phase, the control unit is operable to determine a parameter based on a sum of the multiplication of the current differential traffic backlog with the flow rate of traffic for each unique combination of one upstream link and one downstream link of the plurality of links connected to each of the plurality of junction.

9. The controller according to claim 8, wherein each current differential traffic backlog is determined based on a difference between a current traffic condition of one of the downstream links and a current traffic condition of one of the upstream links.

10. The controller according to claim 9, wherein the current traffic condition comprises a queue length of vehicles at the link.

11. The controller according to claim 8, wherein the flow rate of traffic through each of the plurality of junctions is determined based on a comparison of a current traffic state at each of the plurality of junctions with a prior model or data so as to locate a predetermined flow rate corresponding to the current traffic state.

12. The controller according to claim 8, wherein the flow rate is measured by a traffic monitoring system at each of the plurality of junctions.

13. The controller according to claim 8, wherein the controller is further operable to determine one or more phases having the parameter with a largest value, wherein said one of a plurality of phases activated is one of said one or more phases having the parameter with the largest value.

14. The controller according to claim 8, wherein the upstream link is a link for providing inflow of traffic to each of the plurality of junctions and the downstream link is a link for receiving outflow of traffic from each of the plurality of junctions.

15. A traffic control system for a directed network comprising a plurality of junctions, each of the plurality of junctions having a plurality of links connected thereto, the links comprising one or more upstream links and one or more downstream links, the system comprising:

one or more traffic signal controllers for directing traffic through one or more junctions in the directed network; and one or more traffic monitoring units for monitoring current traffic condition at one or more links and providing data indicative of the current traffic condition at said one or more links to the traffic signal controllers, wherein the traffic signal controller for directing traffic comprises a control unit for activating one of a plurality of phases of each of the plurality of junctions for a predetermined time period which maximizes the directed network throughput based on current differential traffic backlogs between said one or more upstream links and said one or more downstream links connected to each of the plurality of junctions, each phase providing a set of traffic signals at each of the plurality of junctions for guiding traffic from said one or more upstream links to said one or more downstream links, wherein the control unit is operable to activate said one of a plurality of phases based on said current differential traffic backlogs and a flow rate of traffic through each of the plurality of junctions; and wherein for each phase, the control unit is operable to determine a parameter based on a sum of the multiplication of the current differential traffic backlog with the flow rate of traffic for each unique combination of one upstream link and one downstream link of the plurality of links connected to each of the plurality of junction.

16. A non-transitory computer readable medium having stored therein computer executable codes for instructing a computer processor to execute a distributed traffic signal control method for a directed network comprising a plurality of junctions, each of the plurality of junction having a plurality of links connected thereto, the links comprising one or more upstream links and one or more downstream links, the method comprising:

activating one of a plurality of phases of each of the plurality of junctions for a predetermined time period which maximizes the directed network throughput based on current differential traffic backlogs between said one or more upstream links and said one or more downstream links connected to each of the plurality of junctions, each phase providing a unique combination of traffic signals at each of the plurality of junctions for guiding traffic from said one or more upstream links to said one or more downstream links, wherein said activating one of a plurality of phases is based on said current differential traffic backlogs and a flow rate of traffic through each of the plurality of junctions; and determining, for each phase, a parameter based on a sum of the multiplication of the current differential traffic backlog with the flow rate of traffic for each unique combination of one upstream link and one downstream link of the plurality of links connected to each of the plurality of junctions.

* * * * *